US006182798B1

(12) United States Patent
Brady et al.

(10) Patent No.: US 6,182,798 B1
(45) Date of Patent: Feb. 6, 2001

(54) MOBILE LIFTING DEVICE FOR THE DISABLED

(75) Inventors: Kevin Brady; Robert O. Crowley; Cesar W. Mujica, all of Tucson, AZ (US)

(73) Assignee: AGM Container Controls, Inc., Tucson, AZ (US)

( * ) Notice: Under 35 U.S.C. 154(b), the term of this patent shall be extended for 0 days.

(21) Appl. No.: 08/280,430

(22) Filed: Jul. 26, 1994

(51) Int. Cl.[7] ..... B66B 1/36; B66B 13/00
(52) U.S. Cl. ..... 187/282; 187/901; 187/200
(58) Field of Search ..... 187/200, 202, 187/277, 280, 282, 298, 901, 285, 290

(56) References Cited

U.S. PATENT DOCUMENTS

| | | | | |
|---|---|---|---|---|
| 3,902,573 | * | 9/1975 | Grove et al. | 187/29 R |
| 4,176,732 | * | 12/1979 | Nordskog | 187/9 E |
| 4,457,402 | | 7/1984 | Del Vecchio et al. | 187/12 |
| 4,576,539 | * | 3/1986 | Williams | 414/391 |
| 4,785,915 | * | 11/1988 | Shah et al. | 187/110 |
| 4,971,178 | * | 11/1990 | Schauder et al. | 187/117 |
| 5,040,936 | * | 8/1991 | Rhea | 414/540 |
| 5,105,915 | | 4/1992 | Gary | 187/18 |
| 5,154,569 | * | 10/1992 | Eryou et al. | 414/495 |

FOREIGN PATENT DOCUMENTS

| | | | | |
|---|---|---|---|---|
| 1502921 | * | 3/1978 | (GB) | 187/901 |

* cited by examiner

*Primary Examiner*—Robert E. Nappi
(74) *Attorney, Agent, or Firm*—Cahill, Sutton & Thomas

(57) ABSTRACT

A mobile lifting device includes a car having a gate and a docking plate mechanically interconnected at one end of the car. A low voltage DC control system includes an "up" circuit, a "down" circuit connected in parallel with the up circuit, and a sensor circuit in series with the up circuit and down circuit. The sensor circuit includes a plurality of series connected switches for automatically preventing operation of the lifting device if predetermined conditions are not met. The "up" circuit includes a switch positioned on a stage and connected to the control circuit by a coiled cable. A wand on the switch engages a knob on the side of the car when the car reaches the level of the stage, actuating the switch to stop the car. In the event of a power failure, a battery supplies power for opening a solenoid valve to lower the car. Three control panels are provided, one at each end of the car and one in the middle of the car. Each control panel includes a switch for causing the car to be raised or lowered and the switches are electrically interlocked to prevent simultaneous operation of relays for up and down motion. The control panel in the car can be disabled.

24 Claims, 3 Drawing Sheets

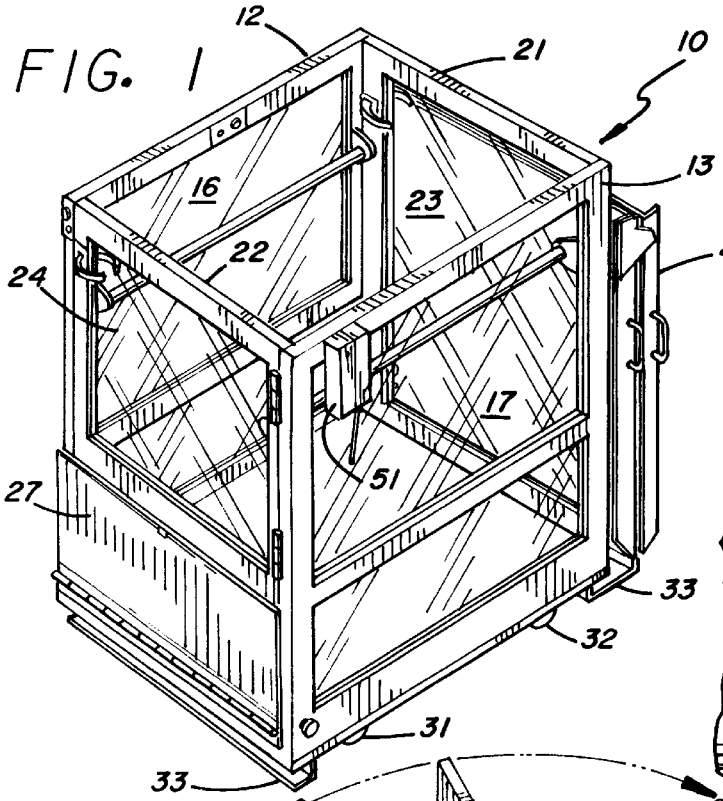
FIG. 1
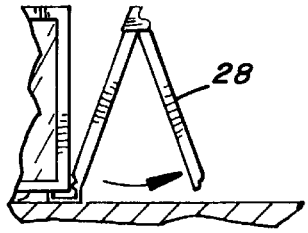
FIG. 2
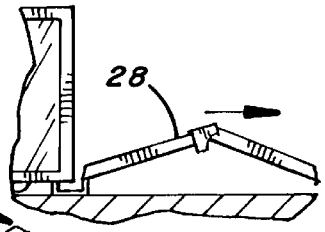
FIG. 3
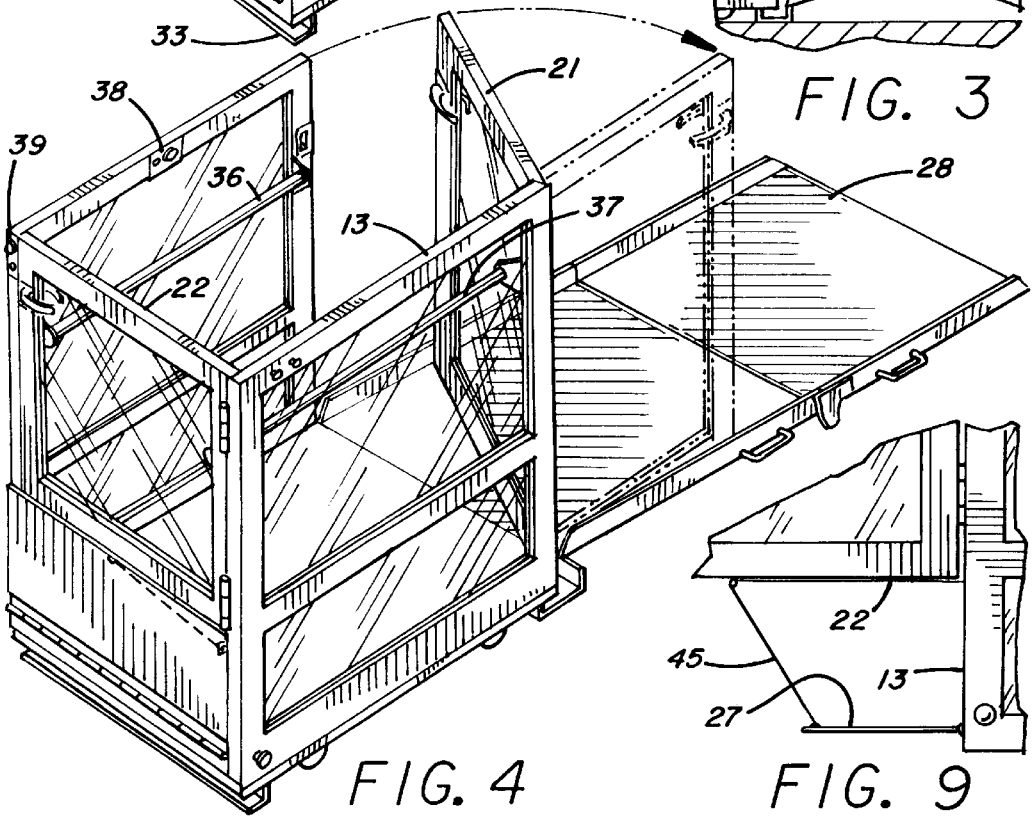
FIG. 4
FIG. 9

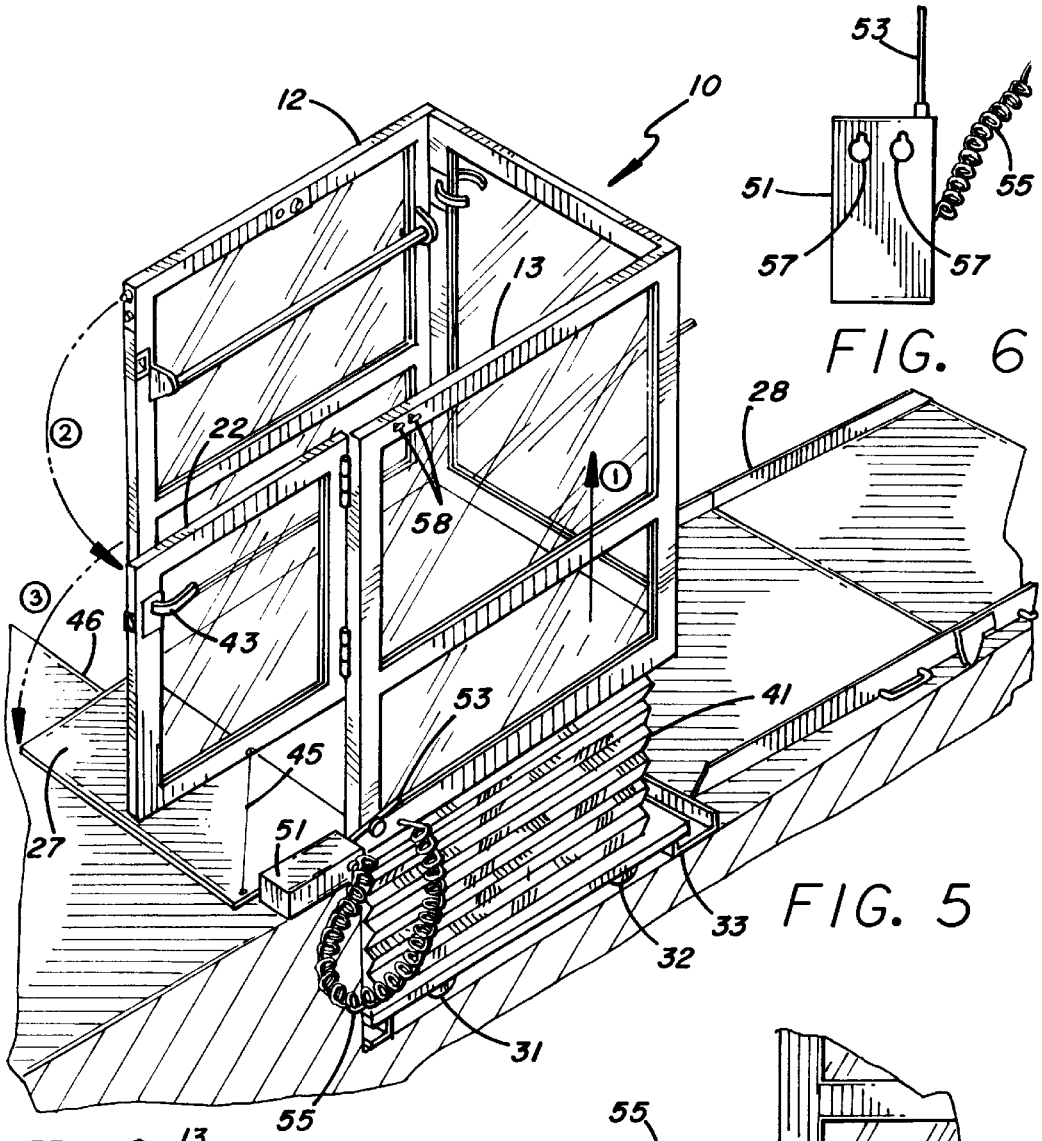
FIG. 5
FIG. 6
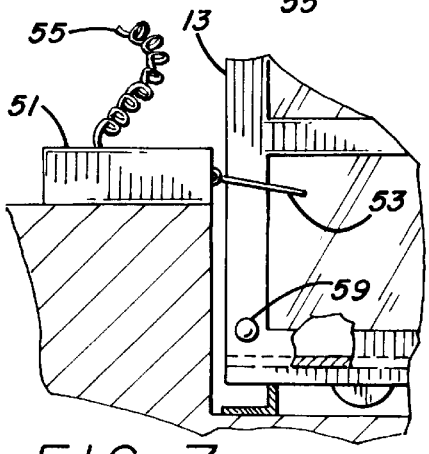
FIG. 7
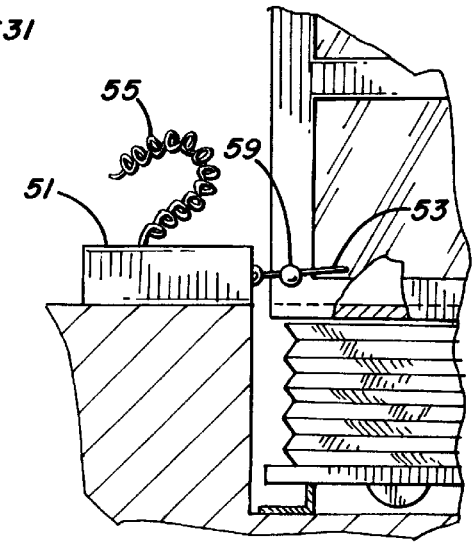
FIG. 8

MOBILE LIFTING DEVICE FOR THE DISABLED

BACKGROUND OF THE INVENTION

This invention relates to a mobile lifting device for the disabled and, in particular, to a lifting device which provides a number of safety features in a coordinated fashion such that the safety features do not encumber the normal operation of the device.

Under the Americans with Disabilities Act of 1990 ("ADA"), the government of the United States of America required that public buildings be accessible to the disabled. For persons requiring a wheelchair for mobility, abrupt changes in floor elevation have to be modified to enable access by wheelchair. For new construction, a ramp is typically provided and the pitch or grade on the ramp can be no greater than one inch of rise per foot of horizontal travel and a horizontal landing five feet in length must be provided for every thirty inches of vertical travel. For older buildings or where space is limited, the requirement for a ramp can cause a problem.

The ADA also permits a vertical lifting device instead of a fixed ramp. Typically, the lifting device is permanently mounted and includes a short ramp for entering a small car which is raised and lowered by a suitable jack mechanism. Under ADA, such lifting devices must have side walls no less than forty-two inches high and include a grab bar on one side wall. Travel surfaces must be non-skid and a safety skirt must enclose the jack mechanism. A "toe guard", for detecting obstructions under the car when the car is being lowered, must also be provided.

Known fixed lifting devices include solid side walls and often omit a gate on one end of the lifting device. Such lifting devices can be uncomfortable to ride if one is claustrophobic or a young child and the open end is unsafe. In many or most cases, the obstruction is less than about forty-two inches high, e.g. the elevation of the first floor above ground level in many buildings or the height of a stage. As used herein, "stage" refers to an elevated floor, whether or not the elevated floor is actually a stage in a theater or in an auditorium.

Mobile lifting devices for the disabled are known in the prior art, e.g. as described in U.S. Pat. No. 5,105,915 (Gary) which describes a lifting device having a car including fixed sides and short, one-piece ramps at each end. The car is raised and lowered by a pantograph jack including a hydraulic pump driven by an electric motor controlled by switches. The patent also describes several lifting devices of the prior art.

A problem with safety devices is that they are often an impediment rather than an aid. Safety interlocks which must be operated by the able-bodied may be a bother but, for the disabled, the interlocks can be an impediment to using what may otherwise be a helpful device. The car in a mobile lifting device is inevitably placed a slight distance from a stage, requiring a docking plate to bridge the gap between the car and the stage. If there is a gate at each end of the car, operating the docking plate and the gate can be a task which a disabled person may not be particularly adept at performing.

ASME (American Society of Mechanical Engineers) standard A17.1 requires lifting devices, except elevators, to have control switches which are effective only when actuated; i.e. momentary contact switches must be used for motion control and raising or lowering the car in a lifting device may occur only while a switch is actuated. The electrical controls of the lifting device must also be manipulated by the disabled person, further complicating the operation of the lifting device.

Having an attendant accompany a disabled person does not necessarily solve the problem of needing manual dexterity to operate a lifting device of the prior art. The attention of the attendant is supposed to be directed to the disabled person, not to operating the lifting device. An attendant could be distracted at a moment of need.

In view of the foregoing, it is therefore an object of the invention to provide a lifting device for the disabled in which the device includes several safety features which are transparent to an operator.

Another object of the invention is to provide a lifting device in which the car can be safely raised and lowered by a passenger or an attendant.

A further object of the invention is to provide a lifting device which can accurately position the car vertically without elaborate calibration.

Another object of the invention is to provide an electrically controlled lifting device which can be lowered despite a power failure.

A further object of the invention is to provide a lifting device for the disabled in which the vertical motion of the car can be stopped at any point by the passenger or an attendant.

Another object of the invention is to provide a lifting device for the disabled in which the car is operated by an attendant to the exclusion of the passenger.

A further object of the invention is to provide a lifting device for the disabled in which the car is operated by an attendant to the exclusion of the passenger, except for emergency stops.

Another object of the invention is to provide a control system for a lifting device in which motion in one direction continues as long as a switch is actuated irrespective of the operation of any other, non-emergency control switch.

A further object of the invention is to provide a control system for a lifting device in which the device is prevented from operating if a plurality of conditions are not met.

Another object of the invention is to provide a control system for a lifting device which gives a visual indication that the car is elevated to the proper height and that a latch is opened, permitting egress from the car.

SUMMARY OF THE INVENTION

The foregoing objects are achieved in the invention in which a mobile lifting device includes a car having a gate and a docking plate mechanically interconnected to facilitate operation of the docking plate. The car is raised and lowered by a hydraulic pantograph jack connecting the car to a wheeled chassis.

A low voltage DC control system includes an "UP" circuit, a "DOWN" circuit connected in parallel with the up circuit, and a sensor circuit in series with the UP circuit and DOWN circuit. The up circuit includes a switch positioned on a stage and connected to the control circuit by a coiled cable. A wand on the switch is aligned with one side of the car and a knob on the side of the car engages the wand when the car reaches the level of the stage, actuating the switch and stopping the car. The sensor circuit includes a plurality of series connected switches which automatically prevent operation of the lifting device if predetermined conditions are not met.

Three control panels are provided for operating the lifting device, one at each end of the car and one in the middle of the car. Each control panel includes a switch for causing the car to be raised or lowered and the switches are electrically interlocked to prevent simultaneous operation of relays for up and down motion. The control panels are selectively enabled by an operator switch. In the event of a power failure, a battery supplies power for operating the "DOWN" circuit which includes a solenoid valve for bleeding off hydraulic fluid to a reservoir, causing the jack to lower under the weight of the car.

BRIEF DESCRIPTION OF THE DRAWINGS

A more complete understanding of the invention can be obtained by considering the following detailed description in conjunction with the accompanying drawings, in which:

FIG. 1 is a perspective view of a lifting device constructed in accordance with the invention;

FIGS. 2 and 3 are side views showing a ramp unfolding;

FIG. 4 is a perspective view showing entry into the car of the lifting device;

FIG. 5 is a perspective view of the lifting device in the raised position next to a stage;

FIG. 6 illustrates a stage sensor constructed in accordance with the invention;

FIGS. 7 and 8 illustrate the operation of the stage sensor;

FIG. 9 is a side view of the mechanical link between the stage end gate and the docking plate.

DETAILED DESCRIPTION OF THE INVENTION

Figure 10:
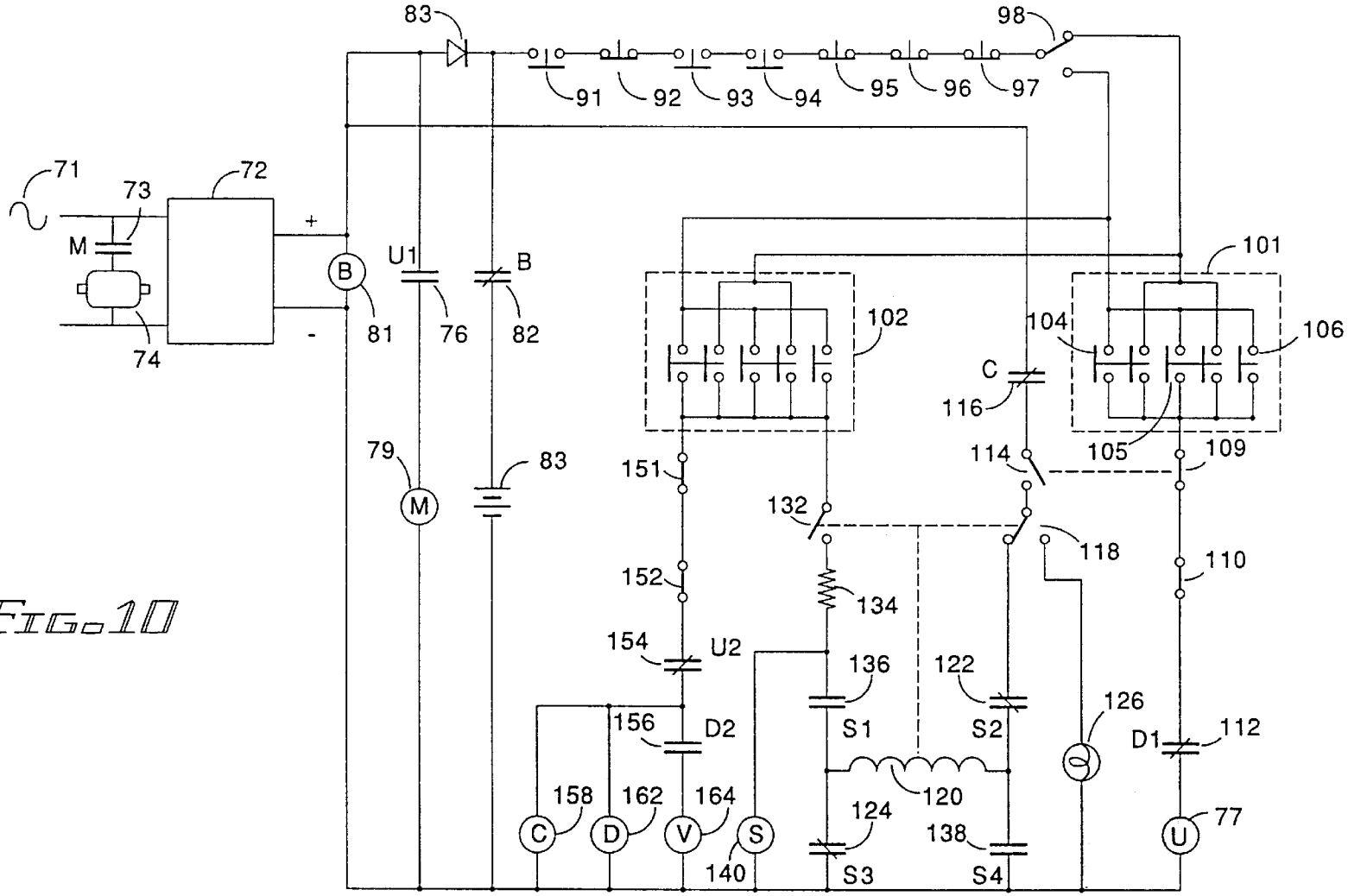
FIG. 10 is a schematic of a control system constructed in accordance with the invention.

FIG. 1 is a perspective view from the stage end of a lifting device constructed in accordance with the invention. Lifting device 10 includes a car having sides 12 and 13 made from tubular aluminum and framing transparent panels 16 and 17. The ends of the car are closed by gates 21 and 22. Gate 21 includes transparent panel 23 and extends the full distance from the tops of sides 12 and 13 to the floor of the car. Gate 22 frames transparent panel 24 and has a top even with sides 12 and 13 but does not extend to the floor of the car. The transparent panels in the sides and gates of the car are preferably made from a transparent, impact resistant thermoplastic such as acrylic or polycarbonate. Docking plate 27 is hinged at the bottom and closes the open area between gate 22 and the floor of the car.

The car rests on a chassis including wheels 31 and 32 and base 33. The car is raised from and lowered to base 33 by a hydraulic jack mechanism (not shown). A suitable jack mechanism is shown and described in the Gary patent. Other jack mechanisms can be used. A hydraulically operated pantograph is preferred for raising and lowering the car because a pantograph has a relatively small minimum height. Wheels 31 and 32 are retractable and, when retracted, base 33 rests on the floor to provide a stable support for the car.

Folding ramp 28 is next to gate 21 in the travel position and extends as shown in FIGS. 2 and 3 when lifting device 10 is in position for use. Ramp 28 provides a transition from ground or floor level to the level of the floor in lifting device 10. In one embodiment of the invention, the floor of the car has a minimum height of six inches above ground level. The maximum height to which the floor of the car can be raised is not critical. It has been found that a vertical lift of approximately forty-two inches is sufficient to accommodate most commonly encountered obstacles, such as the stage in an auditorium.

FIG. 4 illustrates lifting device 10 with ramp 28 fully extended and gate 21 opened to provide access to the car. Ramp 28 is attached to base 33 by a suitable hinge. Within the car, grab rails 36 and 37 extend the length of the respective sides to provide a secure hold for a passenger. Control panel 38 is mounted on an inside surface of side 12 and includes a motion control switch and an emergency stop switch for use by a passenger. As described in more detail below, the motion control switch in panel 38 can be disabled by a key switch located on the outside of the car. Control panel 39, located on an outside end of side 12, also includes a motion control switch and an emergency stop switch. A third control panel (not shown) is located at the opposite end of side 12 near the floor of the car. The third control panel is accessible when the car is raised and control panel 39 is accessible from a stage even if the car is lowered.

After a person enters the car, gate 21 is closed and one of the motion control switches is actuated to cause the car to be raised by the jack. FIG. 5 illustrates lifting device 10 adjacent stage 46 with the car elevated to stage height. The jack and the control system are enclosed by shield or bellows 41. Gate 22 includes electrical interlocks to prevent the gate from opening at an inappropriate time and to protect an occupant from accidentally exiting the car when the car is elevated.

Sensors (not shown in FIG. 5) detect conditions on or about the car and enable access to or from the car as appropriate. The sensors include a detector for determining whether or not ramp 28 is lowered and in place, whether or not the wheels are retracted, and whether or not the gate at either end of the car is open. In addition, a toe guard (not shown) and the emergency stop switches located in each control panel can interrupt the vertical travel of the car. Gate 21 includes a mechanical interlock to prevent the gate from being opened when the car is not fully lowered. A rod in the gate post is raised when the car is lowered, releasing a latch in gate 21.

Stage height is determined by stage sensor 51, shown resting on stage 46. Stage sensor 51 is illustrated in greater detail in FIG. 6 and includes wand 53 extending from one surface of sensor 51. Wand 53 is mechanically coupled to switches within sensor 51 for closing or opening an electrical circuit to indicate that the car has achieved stage height. The switches are connected to the control system of lifting device 10 by coiled cable 55. Sensor 51 includes keyholes 57 for attaching the sensor to pins 58 on side 13 of the car (FIG. 5) when the lifting device is being moved.

When lifting device 10 is positioned adjacent a stage, sensor 51 is removed from side 13 and placed on the stage with wand 15 extending parallel to side 13. FIGS. 7 and 8 illustrate the operation of sensor 51. FIG. 7 illustrates the car in a position below stage height and FIG. 8 illustrates the car at stage height. In FIG. 7, wand 53 is located above knob 59 attached to side 13 and extends downwardly. As the car ascends, knob 59 engages wand 53 (FIG. 8) and raises the wand. As wand 53 is raised, switches within sensor 51 are opened or closed as appropriate, indicating that stage height has been reached. The opening or closing of switches within sensor 51 stops the ascent of the car. Sensor 51 permits the lifting device to be used with a stage of any height within a continuous range of lift and requires no calibration after initial calibration at the factory.

At stage height, a latch is released, permitting the passenger to operate handle 43 and open gate 22. Gate 22 is mechanically coupled to docking plate 27 by tether 45, also shown in a side view in FIG. 9. In one embodiment of the invention, tether 45 is a cable connected between a midpoint on the lower edge of gate 22 and one corner of docking plate 27. As gate 22 is opened, docking plate 27 is lowered onto stage 46. Preferably, sensor 51 is calibrated to stop the ascent of the car when the floor of the car is slightly more than the thickness of docking plate 27 above the height of stage 46, although the stage height position is a matter of choice.

To descend from stage height, a person enters the car and closes gate 22 which automatically raises docking plate 27. If gate 22 is fully closed, the motion control switches are enabled and operating one of the motion control switches will cause the car to descend. When the car is fully lowered, the mechanical interlock in the gatepost is disengaged, gate 21 can be opened, and the person can exit the car by way of ramp 28.

FIG. 10 is a schematic of an electrical control system constructed in accordance with the invention. Power for operating the lifting device is obtained from a 110 volt AC power line, represented by sine wave 71. The 110 volt alternating current is converted into low voltage direct current by power supply 72. A ground fault circuit interrupter (not shown) is preferably connected between a power line and the apparatus of FIG. 10 to protect the operator and/or passenger. Contacts 73 and motor 74 are connected in series across the 110 volt supply. In accordance with one aspect of the invention, the entire control system operates at low voltage and is isolated from the power line voltage by power supply 72. Thus, operating the lifting device is safe.

Contacts 73 are normally open, as are contacts 76 on up relay 77. Contacts 76 are in series between motor relay 79 and the DC supply voltage. Relay 81 is directly connected across the DC supply voltage and controls normally closed contacts 82 in series with backup battery 83. Backup battery 83 provides auxiliary power for operating some of the relays in the control system but not sufficient power for operating motor 74, which is connected to a hydraulic pump for powering the ram in the pantograph jack connected between the car and the chassis. Relay 81 is actuated when the lifting device is plugged into a 110 volt outlet, opening contacts 82. Diode 83 blocks current from battery 83 to relay 81, thereby preventing oscillation of contacts 82.

In the schematic, an UP circuit and a DOWN circuit are connected in parallel with each other and in series with a plurality of switches for assuring safe operation of the car. Switch 91 is normally open and is closed when the chassis rests on the ground, i.e. when the wheels are retracted. Switch 91 is preferably a plunger switch positioned on the chassis to touch the ground when the wheels are raised. Switch 92 is open when the ramp is raised and is closed when the ramp is fully extended. Switch 93 is normally open and is closed when the gate at the stage end of the car is closed and latched. Switch 94 is normally open and is closed when the gate at the ramp end of the car is closed and latched. Switches 95, 96, and 97 are emergency stop switches located at the stage end control panel, the ramp end control panel, and the car control panel, respectively. Since switches 95, 96, and 9,7 are connected in series to power supply 72, these switches will stop the car irrespective of the settings of any other switches in the control system.

Switch 98 is preferably a three position (ON-OFF-ON) switch and is the key switch located at the ramp end of the car. One ON position enables the switches in all three control panels and the other ON position enables only the control panels at each end of the car. The common terminal of switch 98 is coupled to switch 97 and the throws of switch 98 are each connected to up switches 101 and DOWN switches 102. UP switches 101 include ganged switch 104, ganged switch 105, and switch 106. Ganged switch 104 is located at one of the end control panels, ganged switch 105 is located at the other end control panel and switch 106 is located in the car control panel.

Ganged switch 104 has a first terminal connected to a first throw of switch 98 and a second terminal connected to the second throw of switch 98. Ganged switch 105 is similarly connected. Switch 106 is connected to only one throw of switch 98. DOWN switches 102 are connected in the same way to switch 98. When switch 98 is in the position illustrated in FIG. 10, power is applied only to the end control panels and not to the control panel in the car. If switch 98 were in the other ON position, then all three switches in the up and DOWN groups would be powered.

The output from UP switches 101 is connected through stage height switch 109, upper limit switch 110, contacts 112, and up relay 77. Contacts 112 are normally closed, stage height switch 109 is closed until the car has been raised to the stage height, and upper limit switch 110 remains closed unless the car is raised to the uppermost limit of its travel. Thus, closing one of up switches 101 powers relay 77 and closes contacts 76, thereby powering relay 79 which closes contacts 73 and applies power to motor 74. Motor 74 is connected to the hydraulic pump and begins to apply fluid under pressure to a ram in the pantograph jack, thereby raising the car. When the car (FIG. 5) reaches stage height, wand 63 engages knob 64, thereby opening switch 109 (FIG. 10). When switch 109 opens, relay 77 is de-energized, contacts 76 open, relay 79 is de-energized, contacts 73 open, and motor 74 stops.

Stage height switch 109 is mechanically coupled to solenoid switch 114. Solenoid switch 114 is connected through normally closed contacts 116 to power supply 72. When switch 114 closes, power is applied to switch 118 which is a single-pole-double-throw switch mechanically connected to solenoid 120 which is also connected to a plunger in the latch mechanism of the gate on the stage end of the car. Applying direct current through switch 118, normally closed contacts 122, solenoid 120, and normally closed contacts 124 causes the latch in the stage end gate to become unlocked and also causes switch 118 to be thrown to its other position. When switch 118 is thrown in the other position, lamp 126 is lighted to indicate to the passenger that the stage height has been reached and that the stage end gate can be opened. Lamp 126 is preferably located on control panel 38 but can be located anywhere it can be most easily seen.

Switch 118 is ganged with switch 132 which is connected to the output of down switches 102. At stage height, switch 132 remains closed and switch 118 continues to apply power to lamp 126. Switch 118 is connected directly to power supply 72. In the event of a power failure, lamp 126 could rapidly drain battery 83, which is preferably a pair of small nine volt batteries connected in series. Diode 83 serves a second purpose in preventing the drain of battery 83 through lamp 126 in the event of a power failure.

When one of switches 102 is closed, power is applied through switch 132, resistor 134 and relay 140. Since normally open contacts 136 and 138 are open, initially no current flows through solenoid 120 when one of DOWN switches 102 is closed. Relay 140 closes contact 136 and 138 and opens contacts 122 and 124 reversing the connections between solenoid 120 and power supply 72. Current flowing through solenoid 120 opens switch 132 and opens the connection to lamp 126. Solenoid 120 also inserts a latch into the gate lock mechanism at the stage end of the car, thereby preventing the gate from opening.

The output from DOWN switches 102 is also connected through toe guard switch 151, toe guard switch 152, normally closed contacts 154 to DOWN relay 162. Toe guard switches 151 and 152 are normally closed unless a toe guard sensor engages an obstruction, thereby opening one of switches 151 and 152 and stopping the car. Applying power to DOWN relay 162 closes normally open contacts 156 and opens normally closed contacts 112. Closing contacts 156 powers solenoid coil 164 which is mechanically coupled to a bleed valve in the hydraulic system for bleeding hydraulic fluid from the ram into a sump, thereby causing the car to lower.

Normally closed contacts 154 are in series with DOWN relay 162 but are controlled by up relay 77. Similarly, normally closed contacts 112 are in series with up relay 77 but are controlled by DOWN relay 162. This connection provides an interlock such that once one of DOWN switches 102 is closed, closing one of up switches 101 has no effect. Similarly, if one of UP switches 101 is depressed and held down, depressing one of DOWN switches 102 has no effect. Operating any of emergency switches 95, 96, 97 will stop the car.

Closing one of DOWN switches 102 applies power to cut out relay 158, opening normally closed contacts 116 thereby assuring that when solenoid 120 is actuated to lock the stage end gate, throwing switch 118 to the left hand pole will not cause the latch to bounce out from the locked position.

The foregoing description of the operation assumes that switches 91, 92, 93, and 94 are closed and that the conditions sensed by these switches are correct. If any of the conditions sensed by these switches is not fulfilled, then the car will not operate. While numerous safety checks are made, insofar as the operator is concerned a single switch lever is either moved up from a center position to raise the car or down from a center position to lower the car. Thus, the operation of the lifting device is kept simple despite the numerous safety checks and interlocks provided. The operation of the docking plate and the stage end gate are mechanically coupled to simplify the operation of the docking plate, which could be difficult to reach for a physically disabled person.

In the event of a power failure, relay 81 is de-energized, closing contacts 82. Diode 83 provides a third function in isolating back-up battery 83 from contacts 76 and motor relay 79, reducing battery drain if one of UP switches 101 is closed. (Even though the motor and pump would be inoperative in a power failure, motor relay 79 would draw power, to no avail, if contacts 76 were closed and diode 83 were absent.) Power is available through DOWN switches 102 to energize relay 162 which closes contacts 156, energizing solenoid coil 164. Solenoid coil 164 opens a valve in the hydraulic line, relieving pressure in the line and causing the car to lower. Power is unavailable for lamp 126 but is available for solenoid 120 to latch the stage end lock. Power is unavailable for solenoid 120 to unlatch the stage end latch, but this does not matter since one can only go down, not up, if there is a power failure. All safety and emergency switches are functional to stop the car as may become necessary during descent.

Having thus described the invention, it will be apparent to those of skill in the art that various modifications can be made within the scope of the invention. For example, while described in conjunction with electro-mechanical devices, the circuit of FIG. 10 can be implemented with semiconductor devices. Also, the sides and gates can be made from steel or other materials, such as composites. Ultrasonic, RF, or infrared receivers can be substituted for the three control panels and a single switch on a hand-held transmitter could be used instead. At present, either of these modifications would substantially increase the cost of the control system while providing the same functions. Further, the system as described in a preferred embodiment has the advantage of not being susceptible to interference from other transmissions which could actuate a lifting device having an receiver. One could bring contacts 73 and motor 74 over to the DC side of power supply 72, making battery 83 a 12 volt storage battery and power supply 72 a charger, but the cost of the system would increase significantly. While such a change would enable the lifting device to operate during a power failure, it is unlikely that a passenger would want to move onto a stage of unfamiliar shape in what could be total darkness. An electro-mechanical latch could be added to the ramp end of the car, operating in a manner similar to the latch for the stage end of the car. While described as a pantograph jack including an electric motor powering a hydraulic pump, other jacks can be used, e.g. an electrical motor directly connected to a screw mechanism for operating a jack.

What is claimed is:

1. A mobile lifting device comprising:

a car having fixed sides and a first gate at one end of said car;

a wheeled chassis;

a jack coupled to said car and said chassis for raising and lowering said car relative to said chassis; and a dock plate attached to said car at said one end and rotating about a horizontal axis, wherein said dock plate is approximately vertical when said gate is closed and said dock plate is mechanically linked to said gate whereby said dock plate is lowered to an approximately horizontal position as said gate is opened.

2. The mobile lifting device as set forth in claim 1 wherein said sides and said gate each include transparent panels to enclose an occupant of said car while permitting said occupant to see while seated in said car.

3. The mobile lifting device as set forth in claim 1 and further comprising:

a stage height sensor for stopping said car at any point within a continuous range of movement, said sensor including an electrical switch, said switch having a wand extending from said sensor, wherein said car includes a knob attached to one of said sides and said knob engages said wand to actuate said switch when said car is raised to a predetermined height relative to a stage.

4. The mobile lifting device as set forth in claim 3 wherein said stage height sensor is connected to said car by a coiled, multi-conductor cord.

5. The mobile lifting, device as set forth in claim 4 wherein said sensor includes a keyhole and said car includes a pin on one of said sides for engaging said keyhole to mechanically attach said sensor to said car.

6. The mobile lifting device as set forth in claim 1 wherein said car includes a second gate and a ramp at a second end of said car, wherein said ramp folds approximately in half and rests against said second gate for storage.

7. In a mobile lifting device including a vertically movable car and an electro-mechanical jack for raising or lowering said car, the control system comprising:

a first circuit for causing said jack to raise said car;

a second circuit for causing said jack to lower said car;

wherein said first circuit includes a first switch controlled by said second circuit and said second circuit includes a second switch controlled by said first circuit, whereby operating one of said first and second circuits prevents the other of said first and second circuits from operating;

a power supply for converting alternating current into direct current at a low voltage, wherein said first circuit and said second circuit are powered by said direct current.

8. The mobile lifting device as set forth in claim 7 wherein said first circuit and said second circuit are connected in parallel and further comprising:

a third circuit including a plurality of series connected sense switches, said third circuit connected to said power supply in series with said first circuit and said second circuit.

9. The mobile lifting device as set forth in claim 8 wherein said sense switches include an emergency stop switch.

10. The mobile lifting device as set forth in claim 8 wherein said lifting device includes a car having fixed sides, a first gate at one end of said car, and a second gate at a second end of said car;

said third circuit includes a first switch closed by said first gate being closed and a second switch closed by said second gate being closed.

11. The mobile lifting device as set forth in claim 10 wherein said first circuit includes a first control switch located on the outside of said one end of said car, a second control switch located on the outside of said second end of said car, and a third control switch located within said car;

said second control circuit includes a first control switch located on the outside of said one end of said car, a second control switch located on the outside of said second end of said car, and a third control switch located within said car.

12. The mobile lifting device as set forth in claim 11 wherein said third circuit is connected to said first and second circuits by an operator controlled switch for enabling one or more of the control switches.

13. The mobile lifting device as set forth in claim 7 wherein said electro-mechanical jack includes an electric motor connected to said alternating current and further comprising:

a relay having a pair of normally open contacts in series with said electric motor.

14. The mobile lifting device as set forth in claim 13 and further comprising:

a battery coupled to said second circuit for powering said second circuit when said alternating current is interrupted.

15. The mobile lifting device as set forth in claim 14 and further comprising:

a third circuit including a plurality of series connected sense switches, said third circuit connected to said power supply in series with said first circuit and said second circuit, wherein said first circuit and said second circuit are connected in parallel.

16. The mobile lifting device as set forth in claim 15 and further comprising:

a diode connecting said power supply to said third circuit and to said battery for preventing said power supply from draining said battery.

17. The mobile lifting device as set forth in claim 16 wherein said relay is connected to said power supply and said diode isolates said battery from said relay.

18. A mobile lifting device comprising:

a car having fixed sides and a first gate at one end of said car;

a wheeled chassis;

a jack coupled to said car and said chassis for raising and lowering said car relative to said chassis; and a stage height sensor for stopping said car at any point within a continuous range of movement, said sensor including an electrical switch, said switch having a wand extending from said sensor, wherein said car includes a knob attached to one of said sides and said knob engages said wand to actuate said switch when said car is raised to a predetermined height relative to a stage, wherein said stage height sensor is connected to said car by a colied, multi-conductor cord.

19. In a mobile lifting device including a vertically movable car and an electro-mechanical jack for raising or lowering said car, the control system comprising:

a first circuit for causing said jack to raise said car;

a second circuit for causing said jack to lower said car;

a power supply for converting alternating current into direct current at a low voltage, wherein said first circuit and said second circuit are powered by said direct current;

said electro-mechanical jack includes an electric motor powered by said alternating current; and a relay coupled to said first circuit, said relay having a pair of normally open contacts in series with said electric motor.

20. The mobile lifting device as set forth in claim 19 wherein said first circuit and said second circuit are connected in parallel and further including a diode coupled in series between said power supply and said first circuit and said second circuit.

21. The mobile lifting device as set forth in claim 12 wherein said third circuit includes a double throw switch coupled to said first circuit and to said second circuit;

the third control switch in said first circuit and the third control switch in said second circuit are disabled when said double throw switch is at a first throw and said car can be raised or lowered only from outside said car;

the third control switch in said first circuit and the third control switch in said second circuit are enabled when said double throw switch is at a second throw and said car can be raised or lowered from within the car.

22. The mobile lifting device as set forth in claim 21 wherein said sense switches include an emergency stop switch.

23. The mobile lifting device as set forth in claim 22 wherein said sense switches are effective in either position of said double throw switch.

24. The mobile lifting device as set forth in claim 21 wherein said double throw switch is key operated and further includes a center-off position for locking said car from the outside.

* * * * *